US005618233A

United States Patent [19]

Iimura et al.

[11] Patent Number: 5,618,233

[45] Date of Patent: Apr. 8, 1997

[54] RUNNING BODY AND RACING GAME APPARATUS USING THE SAME

[75] Inventors: Kouichi Iimura; Yu Haijima, both of Setagaya-ku, Japan

[73] Assignee: Sigma, Incorporated, Setagayu-ku, Japan

[21] Appl. No.: 383,101

[22] Filed: Feb. 3, 1995

[30] Foreign Application Priority Data

Sep. 16, 1994 [JP] Japan ..... 6-012635 U
Sep. 16, 1994 [JP] Japan ..... 6-248385

[51] Int. Cl.[6] ..... A63F 9/14; A63H 13/02

[52] U.S. Cl. ..... 463/67; 446/285; 446/356

[58] Field of Search ..... 273/86 R, 86 B, 273/86 F, 86 H, 86 G, 85 F; 446/285, 356

[56] References Cited

U.S. PATENT DOCUMENTS

| | | | |
|---|---|---|---|
| 717,202 | 12/1902 | Hubsch | 273/86 A |
| 793,192 | 6/1905 | Harrison | 104/61 |
| 1,462,560 | 7/1923 | Langlume | 273/86 B |
| 1,538,140 | 5/1925 | Spelling | 446/356 |
| 1,553,895 | 9/1925 | Garcia | 273/86 B |
| 1,647,507 | 11/1927 | Cross | 273/86 B |
| 2,180,448 | 11/1939 | Williams | 273/86 B |
| 2,827,296 | 3/1958 | Walker | 273/86 B |
| 3,010,729 | 11/1961 | Tomosy | 446/356 |
| 3,825,256 | 7/1974 | Ochi | 273/86 B |
| 4,251,948 | 2/1981 | Knibbs . | |

FOREIGN PATENT DOCUMENTS

| | | |
|---|---|---|
| 0516160A1 | 12/1992 | European Pat. Off. . |
| 1-94884 | 4/1989 | Japan . |
| 1-152698 | 10/1989 | Japan . |
| 5-135908 | 6/1993 | Japan . |

*Primary Examiner*—Sebastiano Passaniti
*Attorney, Agent, or Firm*—Oliff & Berridge

[57] ABSTRACT

A running body having an animal model with four legs such as a horse model for a horse racing game, and a racing game apparatus using a plurality of the running bodies, are disclosed. Each running body comprises a movable body which can be transferred along a track formed on a table, and an animal model having four legs, of which the fore and hind legs can be swung back and forth accompanying the movement of the movable body and which can move on or above the track. The animal model comprises: a pair of upper limbs of fore legs, each of which conducts a predetermined swinging back and forth on a shaft attached to a barrel of the animal model; a pair of lower limbs of fore legs, each of which conducts a predetermined swinging back and forth on a shaft attached to a lower portion of the upper limb, by the swinging of the pair of upper limbs; and a swinging mechanism for swinging the pair of upper limbs by changing the transfer movement of the movable body to a swinging movement.

28 Claims, 12 Drawing Sheets

RUNNING BODY AND RACING GAME APPARATUS USING THE SAME

BACKGROUND OF THE INVENTION

1. Field of the Invention

The present invention relates to a running body having an animal model with four legs, e.g., a horse model for a horse racing game, a dog model for a dog racing game or the like, in which the fore and hind legs are supported on the barrel of the animal model so as to swing back and forth by a swing mechanism, and to a racing game apparatus using a plurality of the running bodies.

2. Description of Related Art

Such a kind of running body having an animal model with four legs is disclosed, for example, in Japanese Utility Model Application Laid-Open Publication No. Jitsukai-Hei-1-152698.

The running body disclosed in this Publication has a structure in which a horse model is provided on a column which is erected on a movable body so that the horse model can be swung. In the structure, the fore legs and the hind legs of the horse model are operated by a linkage, of which a link is vertically provided in the horse model and is swung by a crank which is connected with an axle of the movable body.

In such a conventional running body having an animal model with four legs, the upper and lower limbs of each fore leg or of each hind leg are formed in one piece, so that relative positions of the upper and lower limbs do not change during travelling of the running body. Although the fore legs and the hind legs are swung back and forth, an action of the fore legs like a raking-in action is not included, so that only an action far from an image of gallop of a racing horse is obtained. Therefore, a conventional racing game using such a running body having an animal model with four legs was not entirely satisfactory to people who hoped to enjoy the game in a sense almost the same as that of a real horse racing.

SUMMARY OF THE INVENTION

The present invention was developed in view of the above-described problem. An object of the present invention is to provide a running body having an animal model with four legs such as a horse model for a horse racing game or the like, which can take action similar to that of a real animal having an animal model with four legs, and to provide a racing game apparatus using a plurality of the running bodies.

In accordance with one aspect of the present invention, the running body comprises a movable body which can be transferred along a track formed on a table, and an animal model having four legs, of which the fore and hind legs can be swung back and forth accompanying the movement of the movable body and which can move on or above the track; wherein the animal model comprises a pair of upper limbs of fore legs, each of which conducts a predetermined swinging back and forth on a shaft attached to a barrel of the animal model; a pair of lower limbs of fore legs, each of which conducts a predetermined swinging back and forth on a shaft attached to a lower portion of the upper limb, by the swinging of the pair of upper limbs; and a swinging mechanism for swinging the pair of upper limbs by changing the transfer movement of the movable body to a swinging movement.

In this running body having an animal model with four legs, since the lower limb of each fore leg can be swung back and forth to the upper limb thereof, it is possible to obtain an action of the fore legs like a raking-in action of an animal having four legs to realize a running body having an animal model with four legs similar to a real one.

The lower limb of each fore leg, preferably, of each of the fore and hind legs, may have a link of which an end is attached to a position apart from the center of the swing of the lower limb so as to form a turning pair with the lower limb, and the upper limb has a slider, provided so as to form a turning pair with the other end of the link, for sliding in a guiding recess formed on the upper limb. The slider may have a pin which is engaged with a cam groove formed on a fixed portion of the barrel of the model.

According to such a structure, because an end of the link forms a turning pair with the lower limb and the other end is connected with a slider of which the movement is controlled by a cam, it is possible to relatively faithfully reproduce delicate movements of the fore legs of an animal having four legs.

The cam groove may comprise a first curved groove with which the pin engages when each fore leg is swinging backward, and a second curved groove, connected with the first curved groove, with which the pin engages when each fore leg is swinging forward. Preferably, a step for preventing the pin of the slider from returning while the pin traces the cam grooves, may be formed at a connecting portion between the first and second curved grooves. Furthermore, the cam groove for a pin of the slider which is provided on the upper limb of each hind leg may comprise a single curved groove with which the pin engages while each hind leg is swinging back and forward.

Accordingly, it is possible to provide predetermined correct motions of each lower limbs with respect to each upper limbs because the pin of the slider is always moved through a regular route.

Preferably, the head of the animal model is swingable back and forth on a shaft attached to the barrel, by a connecting pin connected with the swinging mechanism. The tail of the animal model may be swingable up and down by the swing of a hind leg. According to the movement of the head or the tail, it is possible to delicately express a lively motion of gallop of a horse.

Further, a jockey model having an arm attached to the head of the animal model is preferably provided on the animal model so that the jockey model is swingable back and forth on a pin attached to the barrel, according to the swing of the head of the animal model. Accordingly, it is possible to express the figure of the jockey who desperately hold the reins in order not to be thrown off his horse.

Preferably, the movable body comprises a box-shaped frame which can be transferred by a driving member, a rotatable main wheel provided in the frame to project a portion thereof downward from the bottom of the frame, and a rotatable supplementary wheel provided in the frame, which projects a portion thereof upward from the upper surface of the frame and is elastically movable up and down. The movable body may be set between an upper plate of the table and an intermediate plate provided parallel to and under the upper plate, and the main wheel is in contact with the upper surface of the intermediate plate and the supplementary wheel is in contact with the lower surface of the upper plate. Accordingly, the main wheel surely rolls on the upper surface of the intermediate plate.

Further, a spring is arranged between the supplementary wheel and the bottom of the frame so that the supplementary wheel elastically press the lower surface of the upper plate of the table. Even if the movable body rocks during driving by the chain, at least one pair of the forward and backward pairs of supplementary wheels are surely in contact with the lower surface of the upper plate, so that the main wheels surely roll on the upper surface of the intermediate plate.

Preferably, the transfer movement of the movable body is changed to a rotation of the main wheel and is transmitted to the swinging mechanism through a transmission mechanism. The animal model may be supported on a hollow supporting column which is mounted to erect on the movable body; and the rotation of the main wheel is transmitted to a gear, provided on the barrel and having four cams fixed thereto corresponding to the four legs of the animal model, through a power transmission shaft provided in the hollow supporting column, so that the swings of the upper limbs of the four legs is controlled by the rotation of the corresponding four cams. Each rotation of the four cams is preferably changed to an individual swinging movement by corresponding one of four levers which has a forked portion engaging with the periphery of the corresponding cam, at an end thereof and which is supported by the barrel, so that the swings of the four levers conduct corresponding swings of the upper limbs of the four legs.

In accordance with another aspect of the present invention, the racing game apparatus comprises: a table having a track formed thereon; a plurality of movable bodies which can be transferred along the track; and a plurality of animal models having four legs, which correspond to the plurality of movable bodies one-to-one and can move on or above the track accompanying the movement of the corresponding movable bodies, and the fore and hind legs of each animal model being swung back and forth accompanying the movement of the corresponding movable body, each animal model comprising; a pair of upper limbs of fore legs, each of which conducts a predetermined swinging back and forth on a shaft attached to a barrel of the animal model, a pair of lower limbs of fore legs, each of which conducts a predetermined swinging back and forth on a shaft attached to a lower portion of the upper limb, by the swinging of the pair of upper limbs, and a swinging mechanism for swinging the pair of upper limbs by changing the transfer movement of the corresponding movable body to a swinging movement.

Accordingly, because each animal model used in the apparatus can take actions near an image of gallop of a real racing animal, the racing game apparatus of the present invention can entirely satisfy people who hoped to enjoy the game in a sense almost the same as that of a real animal racing.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Hereinafter, an embodiment of the running body having an animal model with four legs and a racing game apparatus using the running bodies according to the present invention will be explained.

Figure 1:
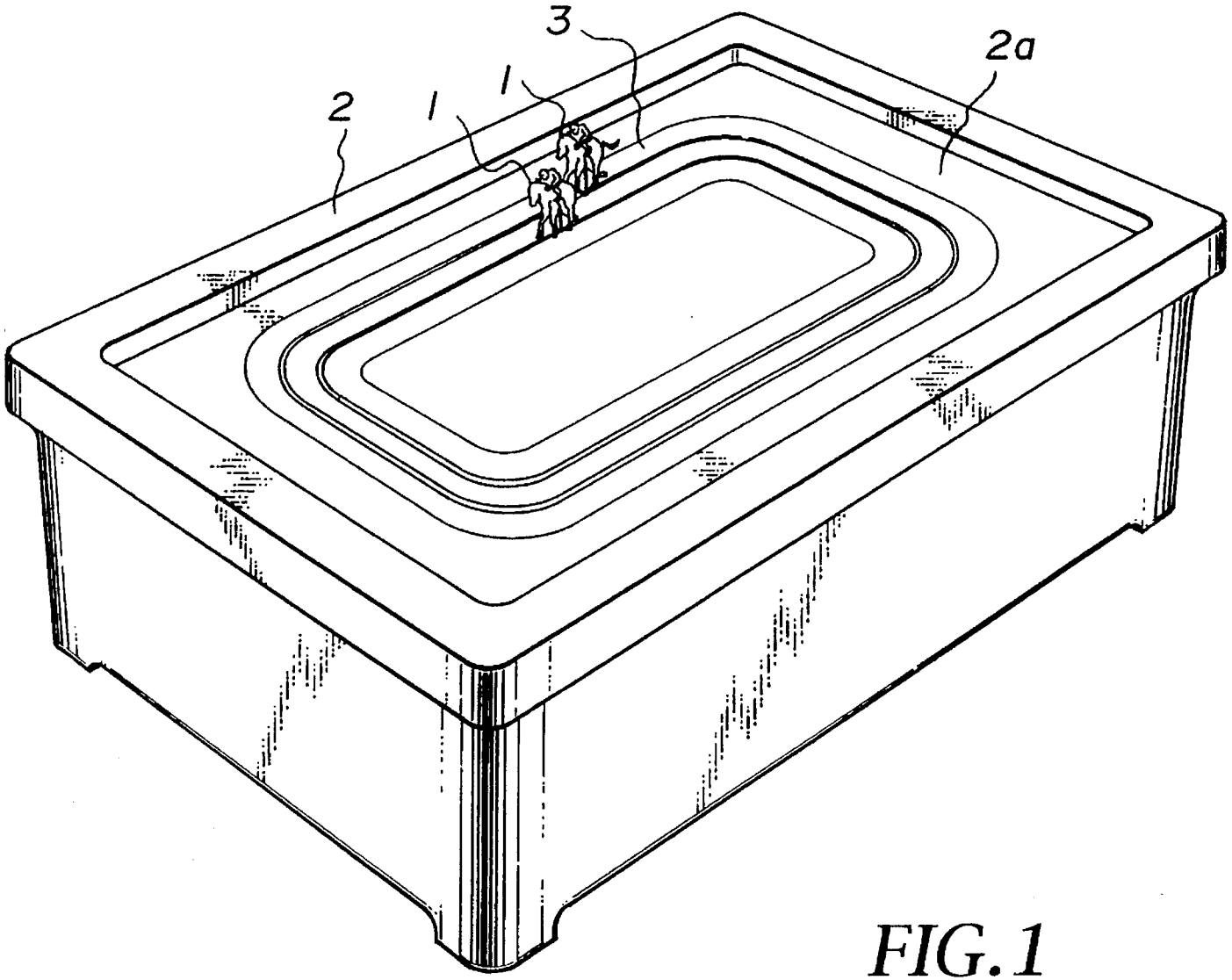
FIG. 1 is a perspective view of a game apparatus of horse racing according to an embodiment of the present invention.

FIG. 1 is a perspective view of a horse racing game apparatus. In the horse racing game apparatus, a track 3 having a plurality of separate courses is provided on the upper surface of a table 2 and a running body 1 having an animal model with four legs runs on or above the track 3.

Figure 2:
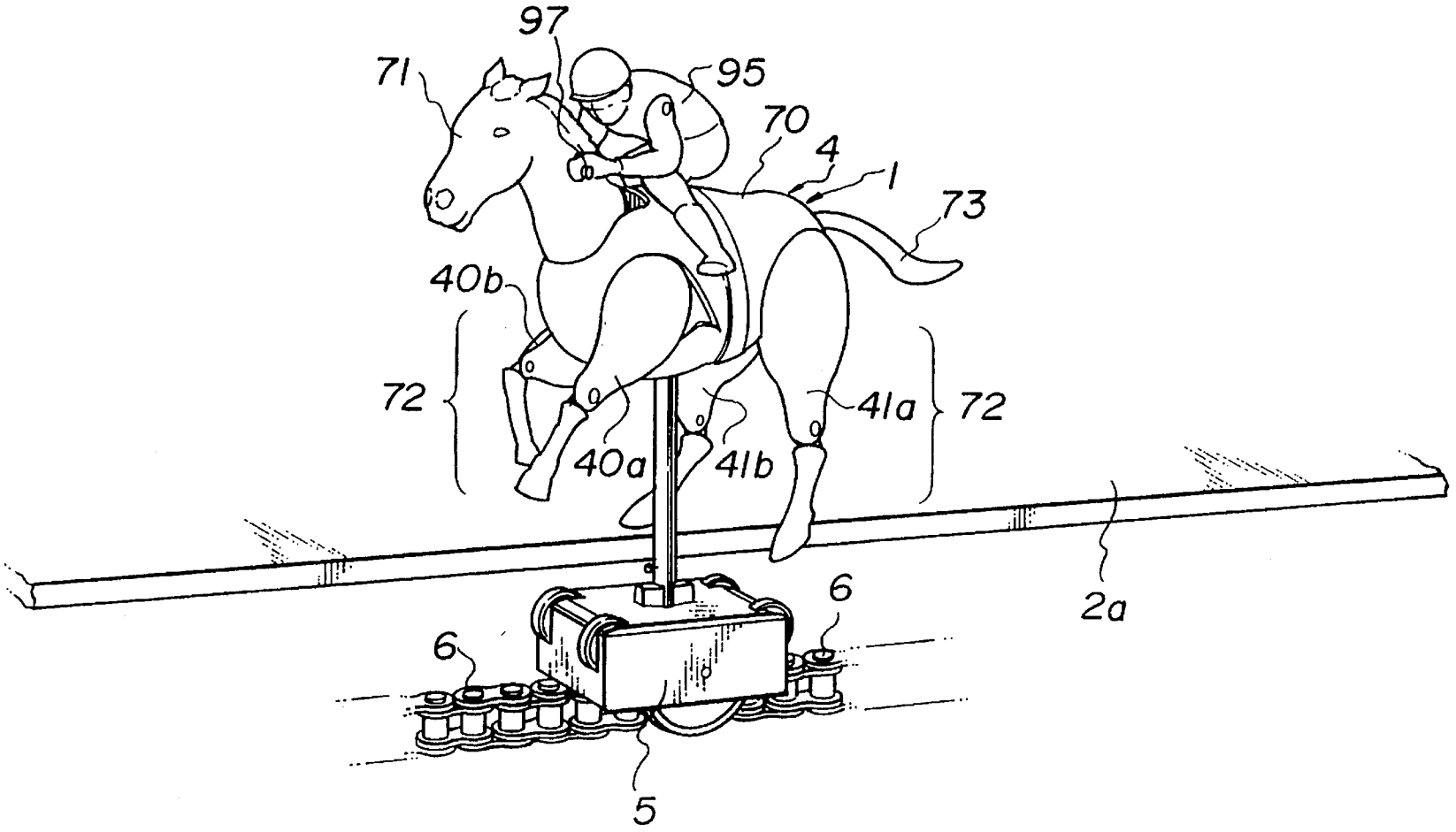
FIG. 2 is a perspective view of a running body according to an embodiment of the present invention.

That is, each running body 1 having an animal model with four legs comprises a horse model 4, as shown in FIG. 2. These horse models 4 are supported on respective movable bodies 5 which are provided under an upper plate 2*a* of the table 2, through a supporting column. The front and rear portions of each movable body 5 are connected with the ends of each chain 6 in the form of a loop. Each chain 6 is engaged with a sprocket which is driven by an individual motor (not shown). The number of revolutions of each motor is continuously controlled by a computer which is not shown. Thus the plurality of horse models 4 may run on respective courses of the track 3 so that the lead shifts rapidly from one contestant to another, by the controlled revolutions of respective motors.

Next, various forms of the horse model 4 during running are explained as follows.

Figure 3A:
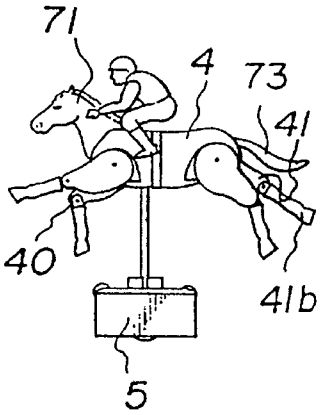
FIGS. 3A to 3E are side views of various actions of the running body.
Figure 3B:
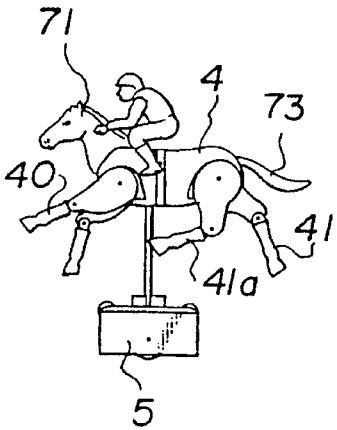
Figure 3C:
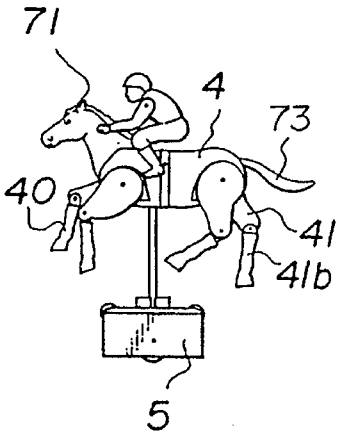
Figure 3D:
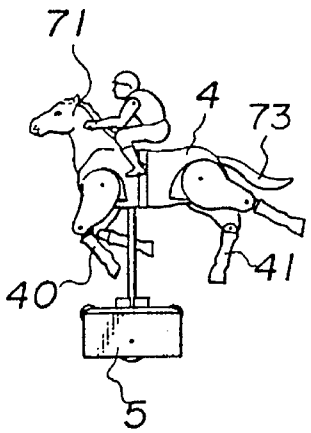
Figure 3E:
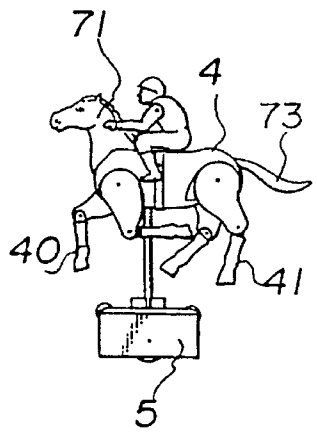

FIG. 3A shows a form of the horse model 4 which is one from a state of both the fore legs 40 and the hind legs 41 being in the air to a state of just before landing of the right-hind leg 41*b*. In this form of the horse model 4, the fore legs 40 and the hind legs 41 are thrown forward and backward, respectively. FIG. 3B shows a form of the horse model 4 which is just a state of landing of the right-hind leg 41*b*. FIG. 3C shows a form of the horse model 4 which is a state of the left-hind leg 41*a* being held out further forward in comparison with the state of FIG. 3B. FIG. 3D shows a form of the horse model 4 in which the hind legs 41 is apart from the ground after transfer of the center of the gravity to the side of the fore legs 40 and a raking-in action of the fore legs 40 is performed. FIG. 3E shows a form of the horse model 4 in which both the fore legs 40 and the hind legs 41 are in the air after the raking-in action of the fore legs 40. In these FIGS. 3A to 3E, the actions of the fore legs 40 and the hind legs 41 are mainly illustrated, and actions of the head 71 and the tail 73 are not illustrated. The horse model is formed so that the head 71 thereof is lowered when the right-fore leg 40*b* is thrown forward as shown in FIG. 2 and the tail 73 is raised when the right-hind leg 41*b* is drawn forward. As described above, the action of the horse model 4 is approximately the same as that of a real racing horse.

The structure of the running body 1 having an animal model with four legs will be explained in detail as follows. The running body 1 comprises a horse model 4 and a movable body 5, as shown in FIG. 2.

Figure 4:
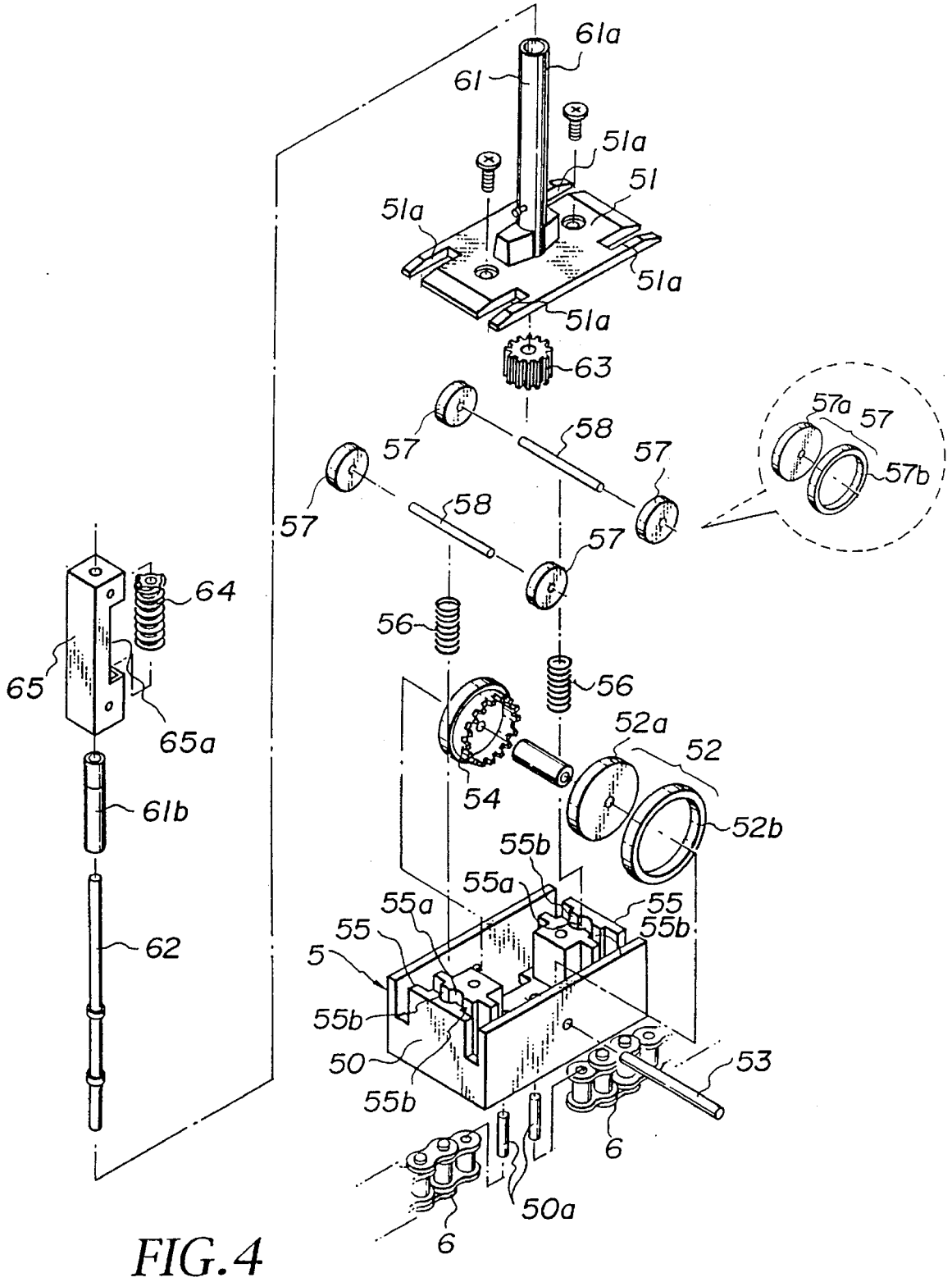
FIG. 4 is an exploded perspective view of the movable body.

The movable body 5 comprises a box-shaped frame 50 and a covering plate 51 which is screwed on the upper end surface of the frame 50, as shown in FIG. 4. A main wheel 52 is attached to the frame 50. The main wheel 52 comprises a wheel body 52*a* and an annular rubber body 52*b* which is attached to the periphery of the wheel body 52*a*. The main wheel 52 projects a portion thereof downward from the frame 50 through an opening (not shown in figures) formed in the bottom of the frame 50. A crown gear 54 is provided on a side of an axle 53 on the other side of which the main wheel 52 is provided so that the crown gear 54 and the main wheel 52 rotate in a body. A pair of bosses 55 having spring receiving holes 55*a* are provided at forward and backward positions in the frame 50. In each spring receiving hole 55*a*, a spring 56 is set. A slit 55*b* in which a shaft 58 can move up and down is formed in each boss 55. On both ends of each shaft 58, a pair of supplementary wheels 57 are attached. Each supplementary wheel 57 comprises a wheel body 57*a* and an annular rubber body 57*b* which is attached to the periphery of the wheel body 57*a*. A pair of pins 50*a* are mounted on the bottom of the frame 50 at forward and backward positions thereof. The pins 50*a* are tightly set in bushes of the ends of the chain 6.

The covering plate 51 is screwed on the bosses 50. At forward and backward positions corresponding to positions of the supplementary wheels 57, of the covering plate 51, four notches 51*a* for receiving the supplementary wheels 57 are formed. Each of the supplementary wheels 57 projects a portion thereof upward from the covering plate through each notch 51*a*. The covering plate 51 functions as a stopper for the shafts 58 energized in an upward direction by the springs 56.

Figure 5A:
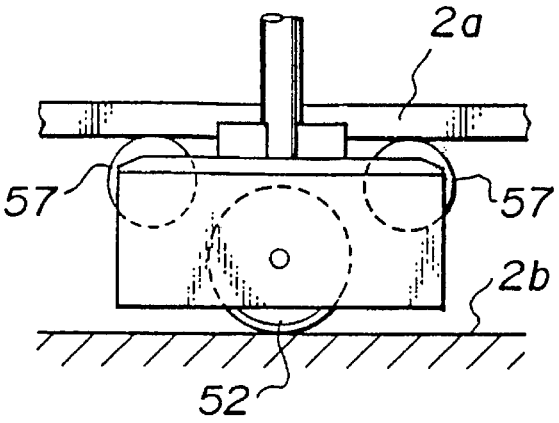
FIGS. 5A to 5C are views for explaining actions of the supplementary wheel of the movable body.
Figure 5B:
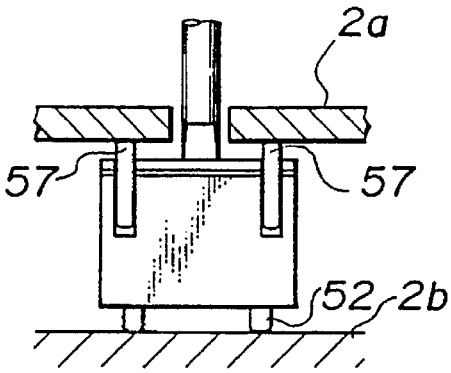
Figure 5C:
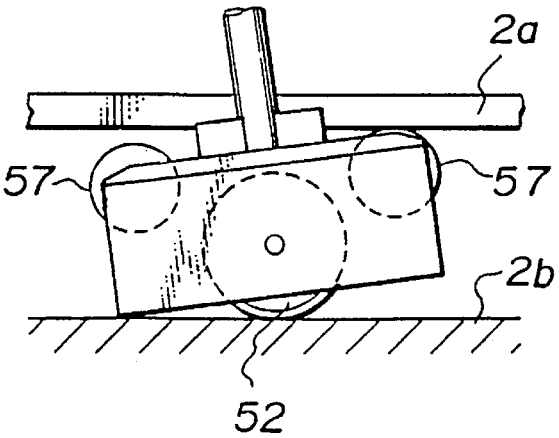

The movable body 5 having such a structure is set between the upper plate 2*a* of the table 2 and an intermediate plate 2*b* provided under the table, as shown in FIGS. 5A and 5B. In this structure, the main wheel 52 is in contact with the upper surface of the intermediate plate 2*b*, and the supplementary wheels 57 are in contact with the lower surface of the upper plate 2*a* by virtue of the action of the springs 56. Even if the movable body 5 rocks during driving of the chain 6, at least one pair of the forward and backward pairs of supplementary wheels 57 are surely in contact with the lower surface of the upper plate 2*a*, so that the main wheels 52 surely roll on the upper surface of the intermediate plate 2*b*. FIG. 5C draws the structure exaggeratedly, and in this figure, the chain 6 is omitted.

A hollow supporting column 61 is mounted to erect on the covering plate 51 of the movable body 5, as shown in FIG. 4. The supporting column 61 comprises a lower column 61*a* and an upper column 61*b* which is tightly fitted in the upper portion of the lower column 61*a*. Passing through the supporting column 61, a power transmission shaft 62 is provided. A pinion gear 63 which stays in mesh with the crown gear 54 is mounted on the lower end of the power transmission shaft 62. A worm gear 64 is mounted on the upper end of the power transmission shaft 62, and surrounded by a box-shaped mounting member 65 which is provided on the upper column 61*b*. A portion of the worm gear 64 is exposed through an opening 65*a* formed in the mounting member 65.

Figure 6:
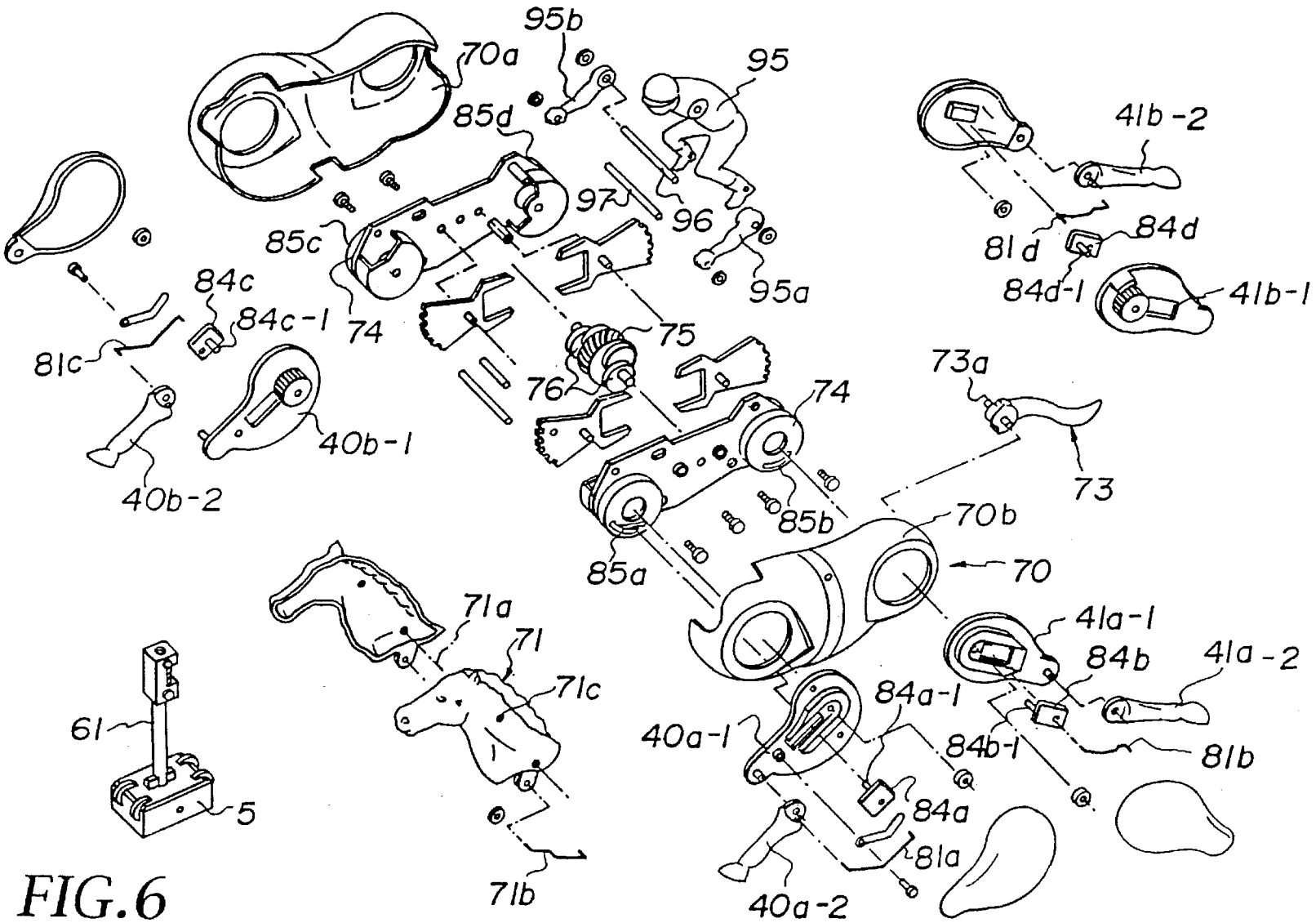
FIG. 6 is an exploded perspective view of the horse model.

The horse model 4 comprises a barrel 70, a head 71, legs 72, and a tail 73, as shown in FIG. 2. The barrel 70 comprises left and right barrel frames 70*a* and 70*b* forming a shell therefor in which a pair of mounting plates 74 and 74 are provided, as shown in FIG. 6. By the pair of mounting plates 74 and 74, a helical gear 75 which is engaged with the worm gear 64 is supported. A pair of double cams 76 are mounted to the left and right sides of the helical gear 75. The left double cams 76 comprise a cam 76*a* for acting upon the left-fore leg 40*a* and a cam 76*b* for acting upon the left-hind leg 41*a*. The right double cams 76 comprise a cam 76*c* for acting upon the right-fore leg 40*b* and a cam 76*d* for acting upon the right-hind leg 41*b*. The phase of the cam 76*a* is different from that of the cam 76*c*. The phase of the cam 76*b* is also different from that of the cam 76*d*. The cam 76*a* engages a forked portion 77*a* which is formed on an end of a lever 77, the cam 76*b* engages a forked portion 78*a* which is formed on an end of a lever 78, the cam 76*c* engages a forked portion 79*a* which is formed on an end of a lever 79, and the cam 76*d* engages a forked portion 80*a* which is formed on an end of a lever 80. These levers 77, 78, 79, and 80 swing on shafts "s". Gears 77*b*, 78*b*, 79*b*, and 80*b* are formed at the other ends of these levers 77, 78, 79, and 80, respectively. These gears 77*b*, 78*b*, 79*b*, and 80*b* engage gears "g" which are rotatable on swing shafts 82, and are fixed on an upper limb 40*a*-1 of the left-fore leg 40*a*, an upper limb 41*a*-1 of the left-hind leg 41*a*, an upper limb 40*b*-1 of the right-fore leg 40*b*, and an upper limb 41*b*-1 of the right-hind leg 41*b*, respectively. Therefore, when the main wheel 52 rolls on the upper surface of the intermediate plate 2*b*, the upper limb 40*a*-1, the upper limb 41*a*-1, the upper limb 40*b*-1, and the upper limb 41*b*-1 are swung back and forth through the mechanism for swinging. In this embodiment, a worm wheel may be used in place of the helical gear 75. A set of bevel gears also may be used in place of the worm gear 64 and the helical gear 75.

Figure 7:
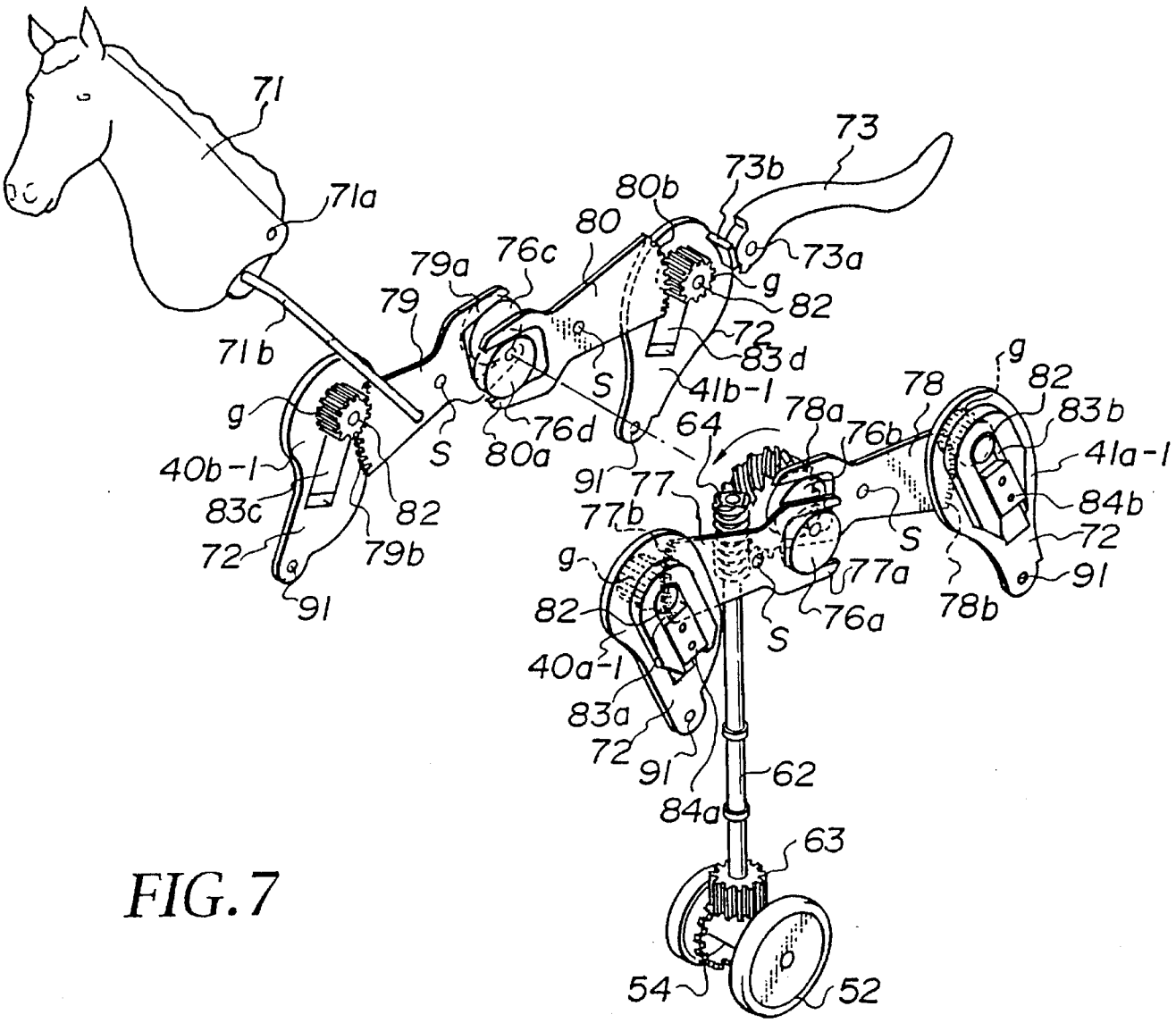
FIG. 7 is a perspective view of the swinging mechanism.

Lower limbs 40*a*-2, 41*a*-2, 40*b*-2, and 41*b*-2 are linked with the upper limb 40*a*-1 of the left-fore leg 40*a*, the upper limb 41*a*-1 of the left-hind leg 41*a*, the upper limb 40*b*-1 of the right-fore leg 40*b*, and the upper limb 41*b*-1 of the right-hind leg 41*b*, respectively, so as to swing on swing shafts 91 as shown in FIGS. 6, 11, 12, 14, and 15. To each of the lower limbs 40*a*-2, 41*a*-2, 40*b*-2, and 41*b*-2, an end of connecting pin (a link) 81*a*, 81*b*, 81*c*, or 81*d* is attached at a position apart from the center of each swing shaft 91 so as to form a turning pair with each lower limb, as shown in FIGS. 10, 11, 13, and 14. On each of the upper limbs 40*a*-1, 41*a*-1, 40*b*-1, and 41*b*-1, a guide groove 83*a*, 83*b*, 83*c*, or 83*d* is provided at a position apart from the center of swinging, i.e., the swing shaft 82, as shown in FIG. 7. In each guide groove 83*a*, 83*b*, 83*c*, or 83*d*, a slider 84*a*, 84*b*, 84*c*, or 84*d*, as shown in FIG. 6, which forms a turning pair with the other end of each connecting pin 81*a*, 81*b*, 81*c*, or 81*d* is arranged. Each slider 84*a*, 84*b*, 84*c*, or 84*d* is movable in each guide groove 83*a*, 83*b*, 83*c*, or 83*d* and is engaged with each cam 85*a*, 85*b*, 85*c*, or 85*d* which is provided in the back side of the upper limb. That is, pins 84*a*-1, 84*b*-1, 84*c*-1, and 84*d*-1 are attached to the backs of the sliders 84*a*, 84*b*, 84*c*, and 84*d*, and further engage with cam grooves of the cams 85*a*, 85*b*, 85*c*, and 85*d*, respectively.

Next, the cams 85*a*, 85*b*, 85*c*, and 85*d* will be explained.

Since the cams 85*a* and 85*c* have laterally symmetrical shapes to each other, only the cam 85*a* will be explained.

Figure 8:
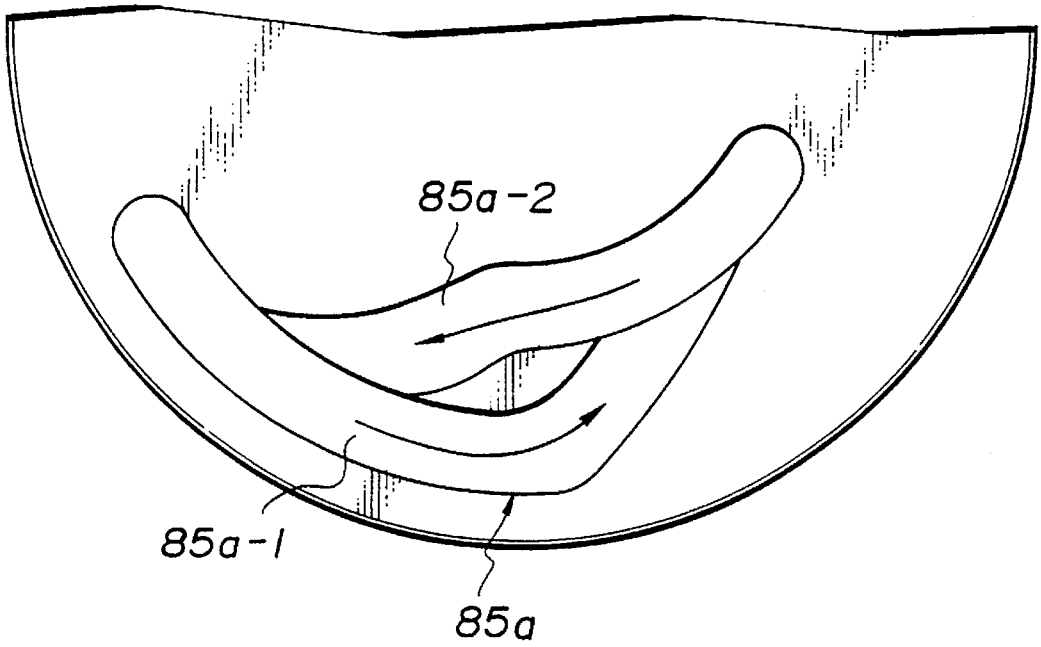
FIG. 8 is a view illustrating the cam for the fore legs.
Figure 10:
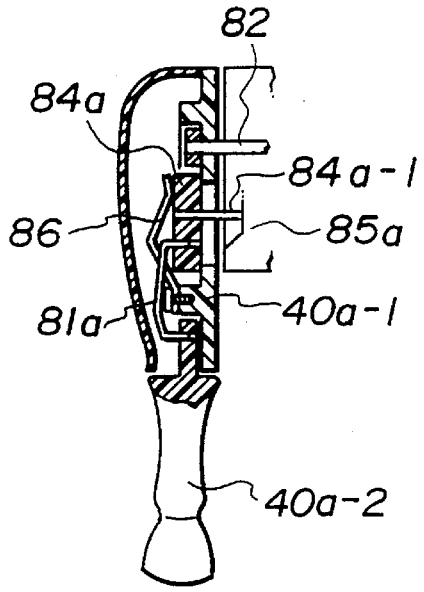
FIG. 10 is a partially sectional rear view of a fore leg.
Figure 11:
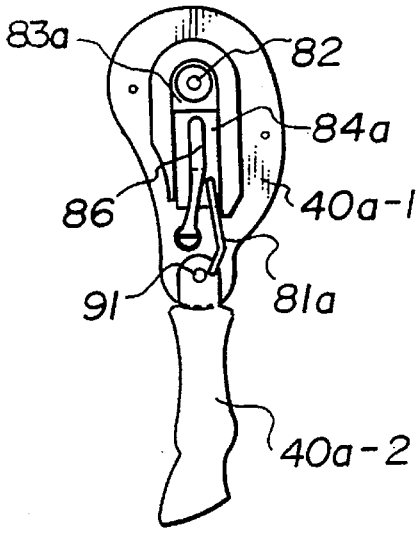
FIG. 11 is a partially cutaway side view of the fore leg.
Figure 12:
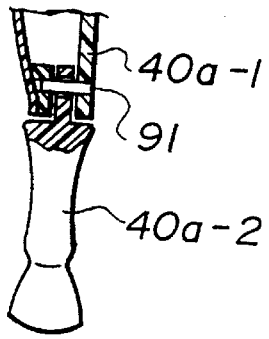
FIG. 12 is a partially sectional rear view of the fore leg.
Figure 13:
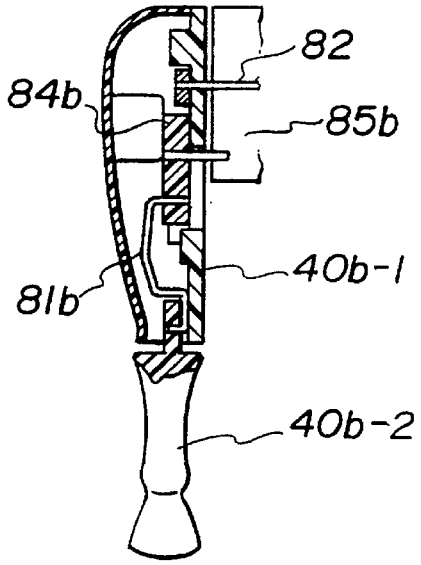
FIG. 13 is a partially sectional rear view of the fore leg.
Figure 14:
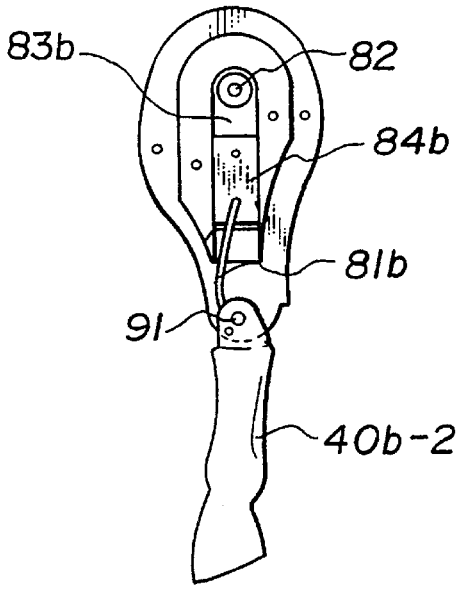
FIG. 14 is a partially cutaway side view of the fore leg.
Figure 15:
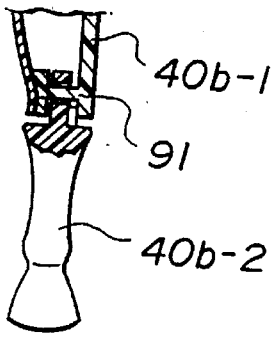
FIG. 15 is a partially sectional rear view of the fore leg.

The cam groove of the cam 85*a* comprises curved grooves 85*a*-1 and 85*a*-2 which are connected with each other, as shown in FIG. 8. In this figure, the bottom surface of the curved groove 85*a*-1 has a gradient rising toward the right. The bottom surface of the curved groove 85*a*-2 has a gradient rising toward the left. At the connecting portion between the curved grooves 85*a*-1 and 85*a*-2, steps are formed. The steps are for preventing the pin 84*a*-1 of the slider 84a from returning while the pin traces the cam grooves. A plate spring 86 is provided on the upper limb in order to press the pin 84*a*-1 toward the bottom surface of the cam groove, as shown in FIGS. 10 and 11.

The function of the cam 85*a* will be explained as follows.

Figures 16A, 16B, 16C, 16D, 16E, 16F:
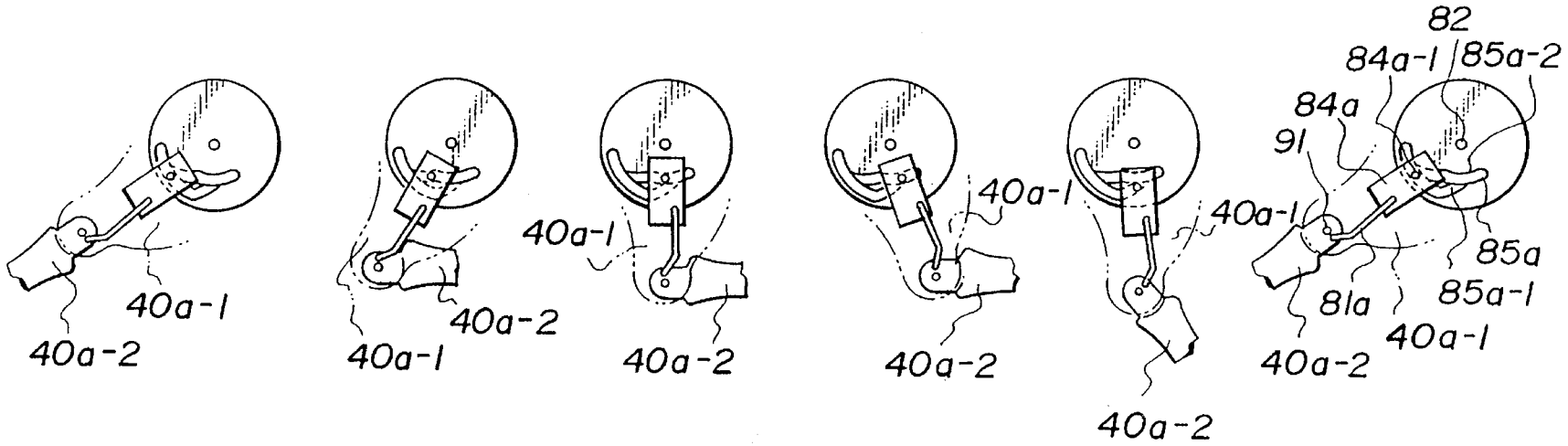
FIGS. 16A to 16F are views of various actions of the fore leg.

When the upper limb 40*a*-1 has swung forward, the pin 84*a*-1 is on the curved groove 85*a*-1 at a position in the vicinity of the connecting portion in the front side so as to arrange the lower limb 40*a*-2 and the upper limb 40*a*-1 in a straight line, as shown in FIG. 16A. Next, when the upper limb 40*a*-1 comes to an intermediate position, the pin 84*a*-1 is on the curved groove 85*a*-1 at a position in the vicinity of the connecting portion in the back side and the lower limb 40*a*-2 turns a little to the back side with respect to the upper limb 40*a*-1, as shown in FIG. 16B. When the upper limb 40*a*-1 further proceeds and swings forward as shown in FIG. 16C, 16D, and 16E, the pin 84*a*-1 is moved forward on the curved grooves 85*a*-2, and the lower limb 40*a*-2 further turns with respect to the upper limb 40*a*-1 in company with the movement of the pin. Thus, the upper and lower limbs 40*a*-1 and 40*a*-2 returns to the state of FIG. 16F, that is, of FIG. 16A.

Figure 9:
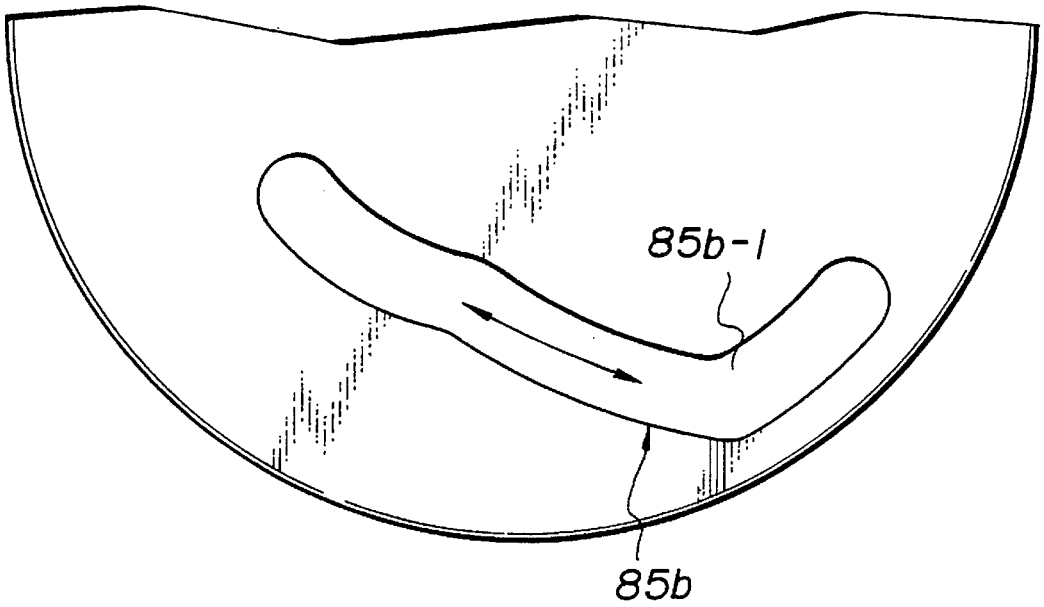
FIG. 9 is a view illustrating the cam for the hind legs.

Since the cam grooves of the cams 85*b* and 85*d* have laterally symmetrical shapes to each other, only the cam 85*b* will be explained. The cam groove of the cam 85*b* comprises a single curved groove 85*b*-1 which has a rising toward the back end, as shown in FIG. 9.

The function of the cam 85*b* will be explained as follows.

Figures 17A, 17B, 17C, 17D, 17E, 17F:
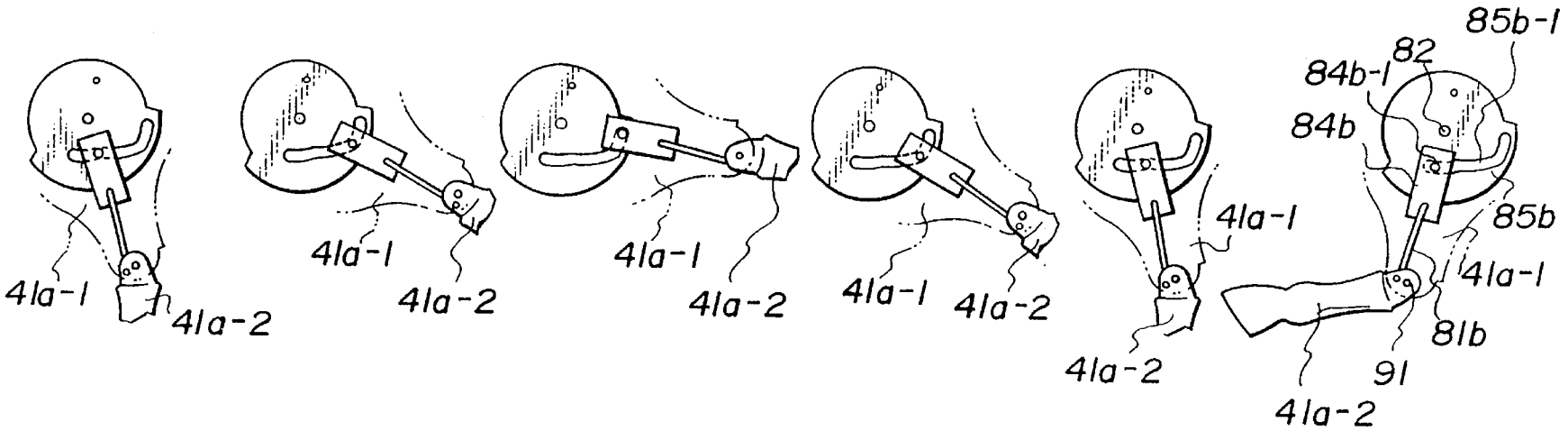
FIGS. 17A to 17F are views of various actions of a hind leg.

When the upper limb 41*a*-1 has swung forward, the pin 84*b*-1 is on the curved groove 85*b*-1 in the front side and the lower limb 41*a*-2 turns forward with respect to the upper limb 41*a*-1, as shown in FIG. 17A. When the upper limb 41*a*-1 further swings backward from the state of FIG. 17A, as shown in FIGS. 17B–17D, the lower limb 40a-2 and the upper limb 40*a*1 come to be in a straight line. When the upper limb 41*a*-1 swings forward from the state of FIG. 17D, as shown in FIGS. 17E and 17F, the lower limb 41*a*-2 gradually turns with respect to the upper limb 41*a*-1 .

Next, the attaching structure for the head 71 will be explained as follows.

The head 71 and the barrel 70 are joined so that the head can swing back and forth on a swing shaft 71*a* attached to the barrel. The head is connected with the lever 79 through a connecting pin 71*b* at a position apart from the swing shaft 71*a*. Therefore, the head 71 swings back and forth on the swing shaft 71*a* in accordance with the movement of the lever 79. According to the movement of the head 71, it is possible to delicately express a lively motion of gallop of a horse.

The tail 73 and the barrel 70 are joined so that the tail 73 can swing up and down on the shaft 73*a* attached to the barrel, as shown in FIG. 7. The tail 73 has a step on a front end surface at a lower position. A projection piece 73*b* is attached to the upper limb 41*b*-1 of the right-hind leg 41*b* so that the projection piece traces the front end surface of the tail 73. The projection piece 73*b* on the upper limb 41*b*-1 comes to touch the step provided on the tail 73 by tracing the end surface of the tail, so that the tail is raised by the step of the tail pushed down by the upper limb. According to the movement of the tail 73, it is possible to delicately express a lively motion of gallop of a horse. The tail 73 comes to hang down by the self-weight thereof.

Next, a jockey model 95 riding on the horse model 4 will be explained as follows.

The left and right arms 95*a* and 95*b* of the jockey model 95 and the barrel 70 are joined so that the jockey model 95 can swing back and forth on a pin supported by the barrel, as shown in FIG. 6. The left arm 95*a* and the right arm 95*b* grasp a shaft 97 which passes through holes 71*c* formed in the head 71 of the horse model 4. The pin is attached to the heels of the jockey model 95 and is got into holes formed in the barrel. Therefore, when the head 71 swings forward, the body of the jockey model 95 is pulled forward, so that the waist of the jockey model is raised. Accordingly, it is possible to express the figure of a jockey who desperately hold the reins in order not to be thrown off his horse.

According to the running body having an animal model with four legs having such a structure, it is possible to provide following effects.

Because the lower limbs 40*a*-2 and 40*b*-2 are operated by the linkage which comprises the upper limbs 40*a*-1 and 40*b*-1 as input links, it is possible to obtain an action of the fore legs 40 like a raking-in action and to provide a horse model 4 which can take action similar to that of a real horse. Because the lower limbs 41*a*-2 and 41*b*-2 of the hind legs are operated by the linkage which comprises the upper limbs 41*a*-1 and 41*b*-1 as input links, it is possible to realize a running body having an animal model with four legs which can take action of the hind legs similar to that of a real horse.

In addition, since the slider 84*a* and the like are added to the linkage and the movement of the slider 84*a* and the like are controlled by the cam 85*a* and the like, it is possible to relatively faithfully reproduce a delicate movement of the fore legs of a real horse. In particular, it is possible to faithfully reproduce a delicate action of the fore legs like a raking-in action of a horse.

Because the movable body 5 has a pair of supplementary wheels 57 which surely transmit the power of the main wheel 52 to the side of the horse model 4, it is possible to prevent action of the legs of the horse model 4 from a stop in the middle of a running.

Because not only the head 71 but the tail 73 are operated, and further also the jockey model 95 is operated accompanying the action of the head 71, it is possible to realize a horse model 4 similar to a real horse.

Although the present invention has been described in its preferred form with a certain degree of particularity, it should also be understood that the present invention is not limited to the preferred embodiment and that various changes and modifications may be made in the invention without departing from the spirit and scope thereof.

For example, although the action of only the fore legs 40 when the fore legs are swinging forward is different from that when the fore legs are swinging backward in the above embodiment, the action of also the hind legs 41 when the hind legs are swinging forward may be different from that when the hind legs are swinging backward. Accordingly, also the hind legs 41 can take a more delicate action.

In the above-described embodiment, although the movable body 5 is transferred by a chain, the movable body 5 may be transferred by driving an annular rack (a gear) which is engaged with the movable body 5, in place of the chain. The annular rack is driven through a gear mechanism.

Further, the movable body 5 may be transferred also by attracting a magnet provided on the movable body by an electromagnet or the like, in place of the chain.

In the embodiment, the movable body 5 which is transferred under the track 3 and the animal model 4 which is transferred on or above the track 3 are connected through the power transmission shaft 62, and transmission of the advance movement of the movable body 5 to the animal model 4 is mechanically carried out through the power transmission shaft 62. The present invention requires the running body to transmit the advance movement of the movable body to the animal model, however, does not necessarily require to provide the movable body under the track. The transmission of the advance movement of the movable body to the animal model may be carried out by another means which is not mechanical, for example, by using attractive force between a first magnet provided on the movable body and a second magnet provided on a lower portion of the animal model.

In the embodiment, the track 3 is divided into a plurality of predetermined separate courses and each animal model moves on or above each separate course. However, the racing game to which the running body of the present invention can be applied, may have a structure without restriction on course on which the animal models can move, that is, outer racing animal models can also move toward the inside on or above the track as needed, as described in Japanese Patent Application Laid-Open Publication No. Tokukai-Hei-1-94884, or Japanese Patent Application No. Tokugan-Hei-5-135908.

The animal model 4 may be slightly vibrated back and forth while the animal model is running, by providing a mechanism for slightly vibrating the entirety of the animal model 4 back and forth. Accordingly, the action of the animal model looks like a real one.

In the above embodiment, although only the case of the running body 1 having an animal model with four legs being a horse model 4 is explained, the running body 1 may be another animal model having four legs such as a dog model.

The running body according to the present invention comprises: a movable body which can be transferred along a track formed on a table; and an animal model having four legs, of which the fore and hind legs can be swung back and forth accompanying the movement of the movable body and which can move on or above the track, the animal model comprising; a pair of upper limbs of fore legs, each of which conducts a predetermined swinging back and forth on a shaft attached to a barrel of the animal model, a pair of lower limbs of fore legs, each of which conducts a predetermined swinging back and forth on a shaft attached to a lower portion of the upper limb, by the swinging of the pair of upper limbs, and a swinging mechanism for swinging the pair of upper limbs by changing the transfer movement of the movable body to a swinging movement. Accordingly, it is possible to realize a running body having an animal model with four legs which can take action similar to that of a real animal having four legs.

What is claimed is:

1. A running body comprising:

a movable body which can be transferred along a track formed on a table; and an animal model having four legs, of which the fore and hind legs can be swung back and forth accompanying the movement of the movable body and which can move on or above the track, the animal model comprising;

a pair of upper limbs of fore legs, each of which conducts a predetermined swinging back and forth on a shaft attached to a barrel of the animal model, a pair of lower limbs of fore legs, each of which conducts a predetermined swinging back and forth on a shaft attached to a lower portion of the upper limb, by the swinging of the pair of upper limbs, and a swinging mechanism for swinging the pair of upper limbs by changing the transfer movement of the movable body to a swinging movement, the swinging mechanism including at least one cam.

2. A running body as claimed in claim 1; wherein the lower limb of each fore leg has a link of which an end is attached to a position apart from the center of the swing of the lower limb so as to form a turning pair with the lower limb, and the upper limb has a slider, provided so as to form a turning pair with the other end of the link, for sliding in a guiding recess formed on the upper limb.

3. A running body as claimed in claim 2; wherein the slider has a pin which is engaged with a cam groove formed on a fixed portion of the barrel of the model.

4. A running body as claimed in claim 3; wherein the cam groove comprises a first curved groove with which the pin engages when each fore leg is swinging backward, and a second curved groove, connected with the first curved groove, with which the pin engages when each fore leg is swinging forward.

5. A running body as claimed in claim 4; wherein a step for preventing the pin of the slider from returning while the pin traces the cam grooves is formed at a connecting portion between the first and second curved grooves.

6. A running body as claimed in claim 1; wherein the lower limb of each of the fore and hind legs has a link of which an end is attached to a position apart from the center of the swing of the lower limb so as to form a turning pair with the lower limb, and the upper limb has a slider, provided so as to form a turning pair with the other end of the link, for sliding in a guiding recess formed on the upper limb.

7. A running body as claimed in claim 6; wherein the slider having a pin which is engaged with a cam groove formed on a fixed portion of the barrel of the model.

8. A running body as claimed in claim 7; wherein the cam groove for a pin of the slider provided on the upper limb of each hind leg comprises a single curved groove with which the pin engages when each hind leg is swinging back and forward.

9. A running body as claimed in claim 1; wherein the head of the animal model is swingable back and forth on a shaft attached to the barrel by a connecting pin connected with the swinging mechanism.

10. A running body as claimed in claim 1; wherein the tail of the animal model is swingable up and down by the swing of a hind leg.

11. A running body as claimed in claim 1; wherein a jockey model having an arm attached to the head of the animal model is provided on the animal model so that the jockey model is swingable back and forth on a pin attached to the barrel, according to the swing of the head of the animal model.

12. A running body as claimed in claim 1; wherein the movable body comprises a box-shaped frame which can be transferred by a driving member, a rotatable main wheel provided in the frame to project a portion thereof downward from the bottom of the frame, and a rotatable supplementary wheel provided in the frame, which projects a portion thereof upward from the upper surface of the frame and is elastically movable up and down.

13. A running body as claimed in claim 12; wherein the movable body is set between an upper plate of the table and an intermediate plate provided parallel to and under the upper plate, and the main wheel is in contact with the upper surface of the intermediate plate and the supplementary wheel is in contact with the lower surface of the upper plate.

14. A running body as claimed in claim 13; wherein a spring is arranged between the supplementary wheel and the bottom of the frame so that the supplementary wheel elastically press the lower surface of the upper plate of the table.

15. A running body as claimed in claim 13; wherein the transfer movement of the movable body is changed to a rotation of the main wheel and is transmitted to the swinging mechanism through a transmission mechanism.

16. A running body as claimed in claim 15; wherein the animal model is supported on a hollow supporting column which is mounted to erect on the movable body; and the rotation of the main wheel is transmitted to a gear, provided on the barrel and having four cams including the at least one cam fixed thereto corresponding to the four legs of the animal model, through a power transmission shaft provided in the hollow supporting column, so that the swings of the upper limbs of the four legs is controlled by the rotation of the corresponding four cams.

17. A running body as claimed in claim 16; wherein each rotation of the four cams is changed to an individual swinging movement by corresponding one of four levers which has a forked portion engaging with the periphery of the corresponding cam, at an end thereof and which is supported by the barrel, so that the swings of the four levers conduct corresponding swings of the upper limbs of the four legs.

18. A running body as claimed in claim 1; wherein the movable body is transferred by a chain.

19. A running body comprising:

a movable means for moving along a track formed on a table to transfer an animal model having four legs on or above the track, a power transmission means for transmitting the transfer movement of the movable means to the side of the animal model, a swing changing means for changing the transmitted power from the power transmission means to four swinging movements which correspond to the respective movements of the four upper limbs of the animal model, the swing changing means including at least one cam, an upper limb swinging means for conducting a predetermined swinging to each of the four upper limbs by the four swinging movements from the swing changing means, and a lower limb swinging means for conducting a predetermined swinging to each of the four lower limbs by the four swinging movements from the upper limb swinging means.

20. A running body as claimed in claim 19, further comprising a head swinging means for swinging the head of the animal model having four legs back and forth.

21. A running body as claimed in claim 19, further comprising a tail swinging means for swinging the tail of the animal model having four legs up and down.

22. A running body comprising an animal model having four legs supported on a movable body through a column, the fore and hind legs of which are supported on the body of the model and can be swung back and forth by a swing mechanism; wherein at least the lower limb of each fore leg can be swung back and forth to the upper limb thereof, and has a link of which an end is provided at a position apart from the center of the swing of the lower limb so as to form a turning pair with the lower limb, and the upper limb has a guiding recess at a position apart from the center of the swing thereof, in the guiding recess a slider being provided so as to form a turning pair with the other end of the linkage, the slider having a projection which is engaged with a cam groove provided on a fixed portion of the barrel of the animal model.

23. A racing game apparatus comprising:

a table having a track formed thereon;

a plurality of movable bodies which can be transferred along the track; and a plurality of animal models having four legs, which correspond to the plurality of movable bodies one-to-one and can move on or above the track accompanying the movement of the corresponding movable bodies, and the fore and hind legs of each animal model being swung back and forth accompanying the movement of the corresponding movable body, each animal model comprising; a pair of upper limbs of fore legs, each of which conducts a predetermined swinging back and forth on a shaft attached to a barrel of the animal model, a pair of lower limbs of fore legs, each of which conducts a predetermined swinging back and forth on a shaft attached to a lower portion of the upper limb, by the swinging of the pair of upper limbs, and a swinging mechanism for swinging the pair of upper limbs by changing the transfer movement of the corresponding movable body to a swinging movement.

24. A racing game apparatus as claimed in claim 23; wherein the track is divided into a plurality of separate courses on or above which corresponding animal models can move.

25. A racing game apparatus as claimed in claim 23; wherein the track has a non-separate course on or above which the animal models can move in not only an advance direction but a perpendicular direction thereof.

26. A racing game apparatus as claimed in claim 23; further comprising an intermediate plate which is provided parallel to and under the table, wherein the plurality of movable bodies are provided between the table and the intermediate plate.

27. A racing game apparatus as claimed in claim 23; wherein each movable body comprises a box-shaped frame which can be transferred by a driving member, a rotatable main wheel provided in the frame to project a portion thereof downward from the bottom of the frame, and a rotatable supplementary wheel provided in the frame, which projects a portion thereof upward from the upper surface of the frame and is elastically movable up and down.

28. A racing game apparatus as claimed in claim 27; wherein each movable body is set between the table and an intermediate plate provided parallel to and under the table, and the main wheel is in contact with the upper surface of the intermediate plate and the supplementary wheel is in contact with the lower surface of the table.

* * * * *